US006990707B1

(12) United States Patent
Heumann et al.

(10) Patent No.: US 6,990,707 B1
(45) Date of Patent: Jan. 31, 2006

(54) CYLINDRICAL MEMBER MAINTENANCE DEVICE

(76) Inventors: Steven A. Heumann, 6808 Hembree La., Windsor, CA (US) 95492; Richard D. Howard, 6808 Hembree La., Windsor, CA (US) 95492

( * ) Notice: Subject to any disclaimer, the term of this patent is extended or adjusted under 35 U.S.C. 154(b) by 279 days.

(21) Appl. No.: 10/459,237

(22) Filed: Jun. 11, 2003

Related U.S. Application Data

(63) Continuation-in-part of application No. 08/659,062, filed on Jun. 3, 1996, now abandoned.

(51) Int. Cl.
*B08B 1/02* (2006.01)
*B08B 1/04* (2006.01)

(52) U.S. Cl. ..... 15/302; 15/309.1; 15/256.6; 15/88; 118/208; 118/DIG. 11; 118/DIG. 21; 118/DIG. 22; 184/17; 184/15.1

(58) Field of Classification Search ..... 15/309.1, 15/302, 256.6, 88, 104.04; 118/DIG. 11, 118/72, DIG. 21, DIG. 22, 325, 208; 184/15.1, 184/17; 401/268, 282
See application file for complete search history.

(56) References Cited

U.S. PATENT DOCUMENTS 2,858,555 A * 11/1958 Medovick ..... 15/88
3,116,811 A * 1/1964 Stevenson ..... 184/17
3,477,081 A * 11/1969 Schmidt ..... 15/88
3,530,526 A * 9/1970 Schmidt ..... 15/302
3,791,330 A * 2/1974 Haddad ..... 114/221 R
4,543,683 A 10/1985 Goldman
4,570,285 A * 2/1986 Skelton ..... 15/256.6
4,734,950 A * 4/1988 Schenke et al. ..... 15/88
4,982,473 A 1/1991 Farris et al.

FOREIGN PATENT DOCUMENTS

FR 2396443 * 1/1979
GB 2131465 6/1984

* cited by examiner

*Primary Examiner*—Gary K. Graham
(74) *Attorney, Agent, or Firm*—Jack Lo

(57) ABSTRACT

A cylindrical member maintenance device is comprised of a housing comprised of two hinged halves for being closed around a cylindrical member, such as a stranded steel cable. A rotary helical brush assembly and a rotary longitudinal brush assembly are positioned in the housing and rotatable about an axis of the housing. Each rotary brush assembly is comprised of coaxial split rings with rotary cylindrical wire brushes connected in between and which are independently rotatable about their own axes. Nozzles are positioned on the inside of the housing for applying a cleaning fluid or paint to the cylindrical member. Apertures in the housing are for connecting to a suction device for removing debris, cleaning fluid, and paint to avoid contaminating the environment. Loops on the housing are for attaching to cables for moving the housing along the cylindrical member.

13 Claims, 4 Drawing Sheets

CYLINDRICAL MEMBER MAINTENANCE DEVICE

CROSS REFERENCE TO RELATED APPLICATIONS

This is a continuation-in-part of application Ser. No. 08/659,062 filed on Jun. 3, 1996 now abandoned.

BACKGROUND OF THE INVENTION

1. Field of the Invention

The invention broadly relates to devices for cleaning structural cables and other cylindrical members.

2. Prior Art

A braided steel cable, such as the type used on suspension bridges, is comprised of a plurality of braided strands helically wrapped around a solid core. The cable is made of steel and thus requires periodic maintenance to prevent rusting. Such maintenance is comprised of removing surface dirt, rust, and old paint, then painting the cleaned surface.

A typical cleaning device for cleaning braided steel cables is comprised of a housing which positions wire brushes around a cable. When the cleaning device is moved along the cable, the cable is cleaned by the wire brushes. Some cleaning devices apply a cleaning fluid. Prior art cable cleaners can clean the lands of the cable, that is, the outermost parts of the strands, but cannot clean deep inside the grooves between adjacent strands. Also, the wire brushes wear out quickly. Further, debris and cleaning fluids fly out from the cleaning device as environmental contaminants.

BRIEF SUMMARY OF THE INVENTION

Objects of the present cylindrical member maintenance device are:

- to clean a cylindrical member, such as a braided steel cable;
- to apply a cleaning fluid to the cylindrical member for better cleaning;
- to thoroughly clean the lands and grooves of the cable;
- to paint the cylindrical member after cleaning;
- to avoid releasing debris, cleaning fluid, or paint into the environment; and
- to make the brushes more durable.

The present cylindrical member maintenance device is comprised of a housing comprised of two hinged halves for being closed around a cylindrical member, such as a braided steel cable. Centering rings in the housing fit closely around the cylindrical member to center the housing and to seal the interior from the outside environment. A rotary helical brush assembly and a rotary longitudinal brush assembly are positioned in the housing and rotatable about an axis of the housing. The rotary helical brush assembly is comprised of coaxial rings with cylindrical wire brushes connected in between in a helical arrangement. The rotary longitudinal brush assembly is comprised of coaxial rings with cylindrical wire brushes connected in between in a longitudinal arrangement. The brushes in either brush assembly are independently rotatable about their own axes. Nozzles are positioned on the inside of the housing for applying a material such as a cleaning fluid or paint to the cylindrical member. Apertures in the housing are for connecting to a suction device for removing debris, cleaning fluid, and paint to avoid contaminating the environment. Connectors on the housing are for attaching to cables for moving the housing along the cylindrical member.

Figure 1:
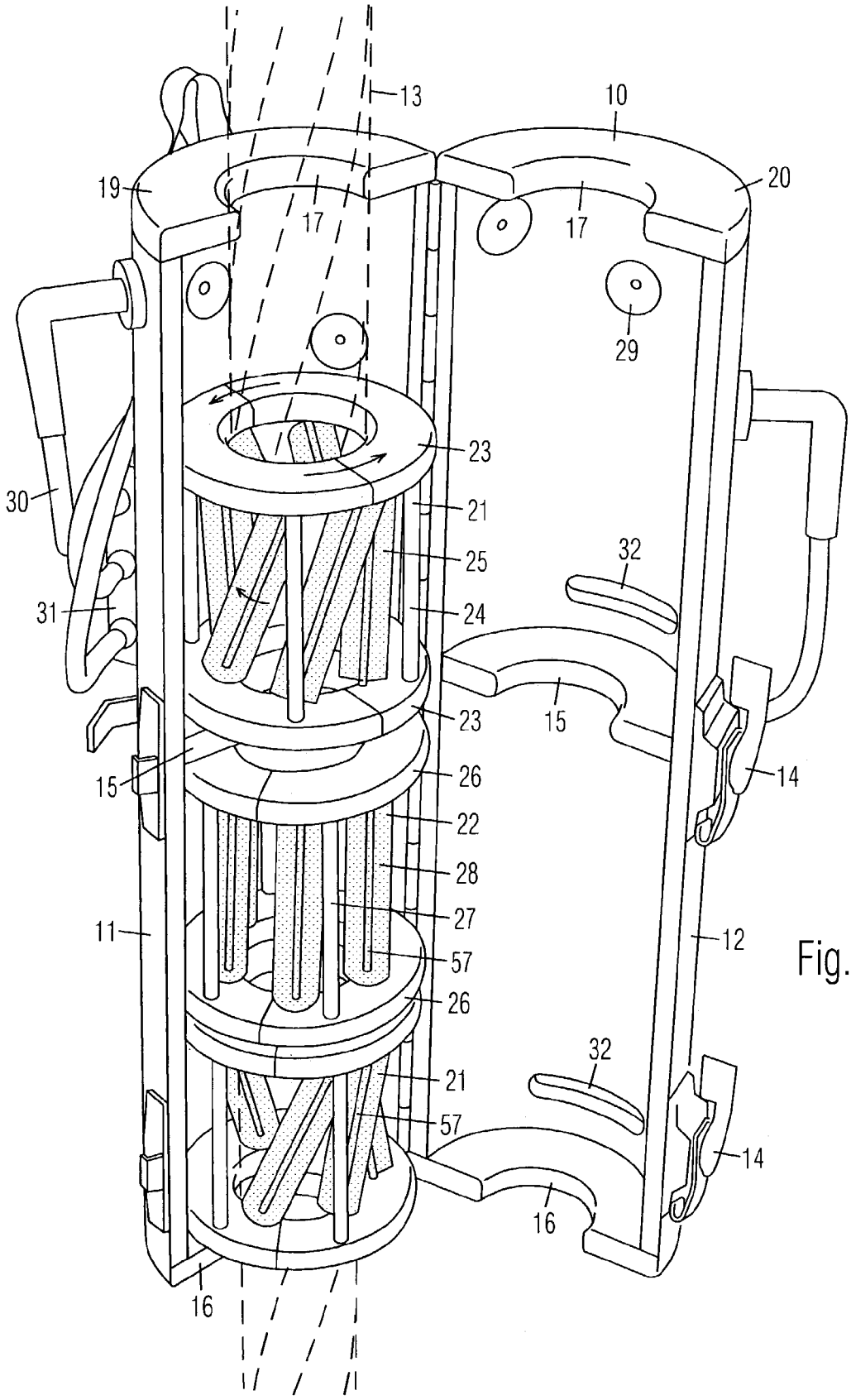
FIG. 1 is a perspective view of a cylindrical member maintenance device in an opened condition.

| DRAWING REFERENCE NUMERALS | |
|---|---|
| 10. Housing | 11. Half Housing |
| 12. Half Housing | 13. Cylindrical Member |
| 14. Latch | 15. Alignment Ring |
| 16. Alignment Ring | 17. Sealing Ring |
| 18. Loops | 19. Half Ring |
| 20. Half Ring | 21. Helical Brush Assembly |
| 22. Longitudinal Brush Assembly | 23. Split Ring |
| 24. Spacer | 25. Wire Brush |
| 26. Split Ring | 27. Spacer |
| 28. Wire Brush | 29. Nozzle |
| 30. Hose | 31. Distribution Chamber |
| 32. Suction Aperture | 33. Connector |
| 34. Valve | 35. Pressure Gauge |
| 36. Distribution Chamber | 37. Connector |
| 38. Helical Strands | 39. Groove |
| 40. Land | 41. Half Ring |
| 42. Half Ring | 43. Pin |
| 44. Hole | 45. Projection |
| 46. Housing | 47. Half Housing |
| 48. Half Housing | 49. Pin |
| 50. Hole | 51. Brushes |
| 52. Split Ring | 53. Split Ring |
| 54. Axle | 55. Cylindrical Member |
| 56. Helical Strand | 57. Axle |

DETAILED DESCRIPTION OF THE INVENTION

FIG. 1:

A cylindrical member maintenance device is shown in a perspective view in FIG. 1 in an opened position. It is comprised of a housing 10 comprised of two half housings 11 and 12 hinged together for opening and closing around a cylindrical member 13, such as a braided steel cable. Alternatively, half housings 11 and 12 may be completely detachable from each other. The cleaner can be used for cleaning other types of cylindrical members, such as pipes. Half housings 11 and 12 are locked together by latches 14 after they are closed around cylindrical member 13.

Split alignment rings 15 and 16 in housing align cylindrical member 13 therein and seal the interior of housing 10 from the outside environment. A split sealing ring 17 is positioned at a first end of housing 10. Sealing ring 17 has a slightly larger inner diameter than those of alignment rings 15 and 16 to avoid touching cylindrical member 13. Rings 15–17 are each comprised of two half rings 19 and 20 attached to respective half housings 11 and 12, so that rings 15–17 can be opened and closed around cylindrical member 13.

Rotary helical brush assemblies 21 and a rotary longitudinal brush assembly 22 are positioned in housing 10 and rotatable about an axis thereof. There may be any number of each type of brush assembly. Rotary helical brush assembly 21 is comprised of coaxial split rings 23 connected by spacers 24 and rotary cylindrical wire brushes 25 in a helical arrangement. Rotary longitudinal 11 brush assembly 22 is comprised of coaxial split rings 26 connected by spacers 27 and cylindrical wire brushes 28 in a longitudinal arrangement. The brushes in either brush assembly are independently rotatable about their own axle 57. Each brush assembly can be opened and closed around cylindrical member 13.

Nozzles 29 are positioned inside housing 10 in a space between brush assembly 21 and sealing ring 17 for applying a material to cylindrical member 13, such as a chemical cleaner, steam, abrasives, paint, etc. Nozzles 29 are connected by hoses 30 to a distribution chamber 31 attached to the outside of housing 10. Suction apertures 32 in housing 10 are for connecting to a suction device (not shown) for removing debris and waste fluid from inside housing 10 to avoid contaminating the outside environment.

Figure 2:
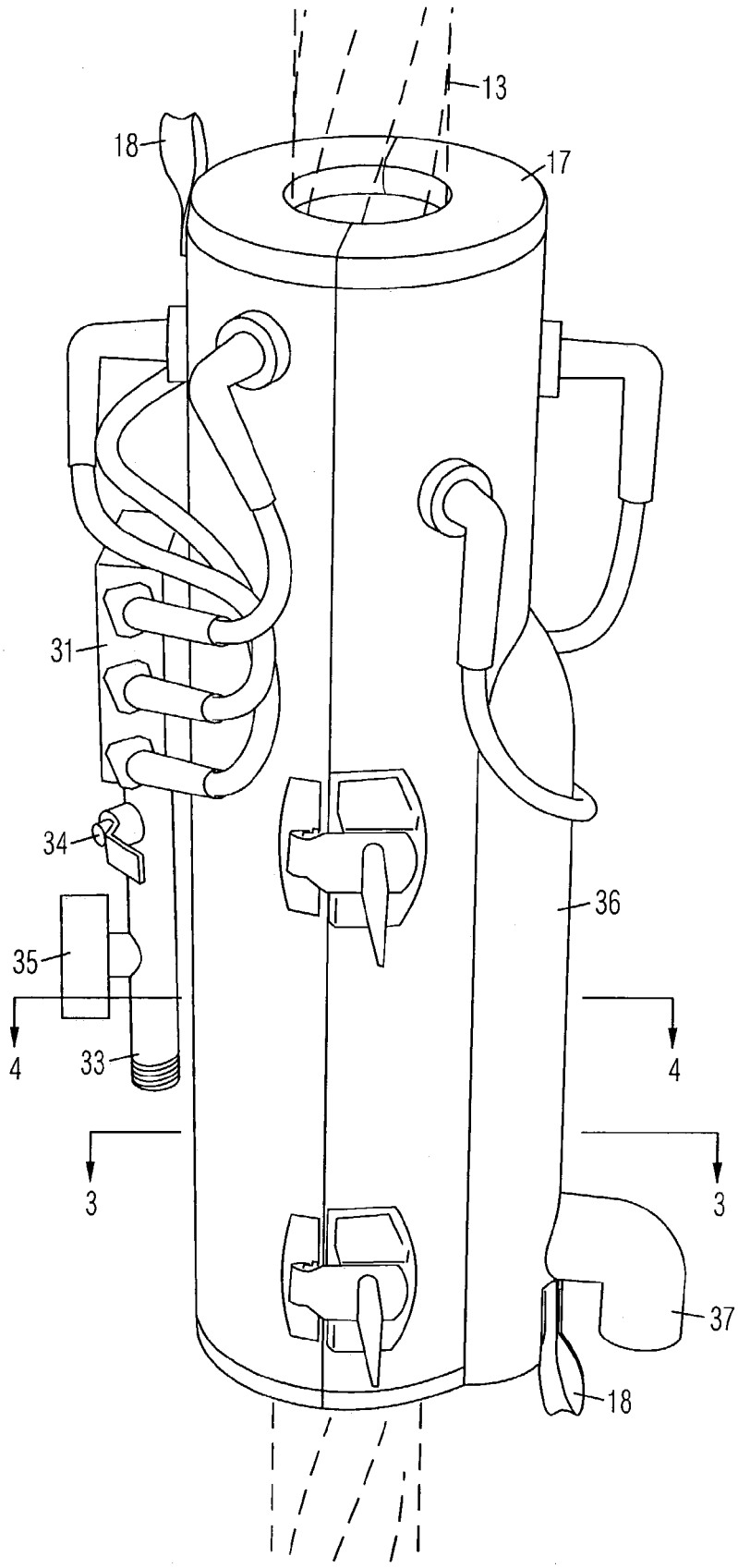
FIG. 2 is a perspective view thereof in a closed condition.

FIG. 2:

The cylindrical member maintenance device is shown in a closed position around cylindrical member 13 in FIG. 2. A connector 33 extending from chamber 31 is arranged for connecting to a pressurized source of fluid (not shown), such as a cleaning fluid or paint. A valve 34 and a pressure gauge 35 are also connected to chamber 31. When the fluid is sprayed onto cylindrical member 13 by nozzles 29 (FIG. 1), it is contained within housing 10 to avoid contaminating the outside environment.

A suction distribution chamber 36 is connected to suction apertures 29 (FIG. 1). A connector 37 on chamber 36 is for connecting to a suction device (not shown). Loops 18 on housing 10 are for attaching to cables (not shown) for moving housing 10 along cylindrical member 13. Loops 18 are positioned on opposite sides of housing 10 to prevent housing 10 from rotating about cylindrical member 13.

When the cylindrical member maintenance device is used for cleaning the steel cable, it may be moved in an upward direction along the steel cable. When the cylindrical member maintenance device is used for painting the steel cable, it may be moved in a downward direction along the steel cable. The painted portion will only travel past sealing ring 17, which has a slightly larger hole than alignment rings 15 and 16 (FIG. 1) to avoid touching the freshly painted portion of the steel cable.

Figure 3:
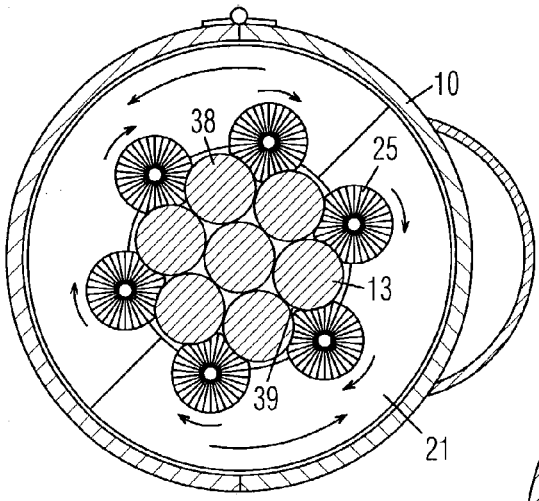
FIG. 3 is a sectional view thereof taken along line 3—3 in FIG. 2.

FIG. 3:

A sectional view of rotary helical brush assembly 21 is shown in FIG. 3 positioned around a cylindrical member 13 which in this example is comprised of a braided steel cable with helical strands 38. The number of cylindrical brushes 25 is selected to match the number of strands 38 in the steel cable. Cylindrical brushes 25 are canted (see FIG. 1) to align with helical grooves 39 between helical strands 38 of the steel cable for cleaning grooves 39.

As housing 10 is moved along the steel cable, brush assembly 21 is rotated about the axis of the steel cable as brushes 25 are guided along helical grooves 39. The friction with grooves 39 cause cylindrical brushes 25 to rotate about their own axes independently of each other in a direction opposite the rotation of brush assembly 21 for better cleaning. The rotation of brushes 25 about their own axes also enable to them wear longer because individual bristles are in contact with the steel cable only some of the time.

Figure 4:
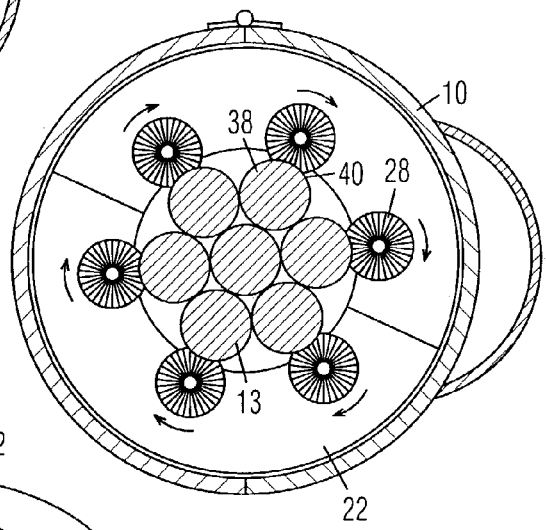
FIG. 4 is a sectional view thereof taken along line 4—4 in FIG. 2.

FIG. 4:

A sectional view of rotary longitudinal brush assembly 22 is shown in FIG. 4 positioned around the steel cable. Cylindrical brushes 28 are aligned with the axis of the steel cable, and are positioned to engage raised portions or lands 40 of strands in the steel cable. Brushes 28 are caused by helical strands 38 to rotate about their own axes.

Figure 5:
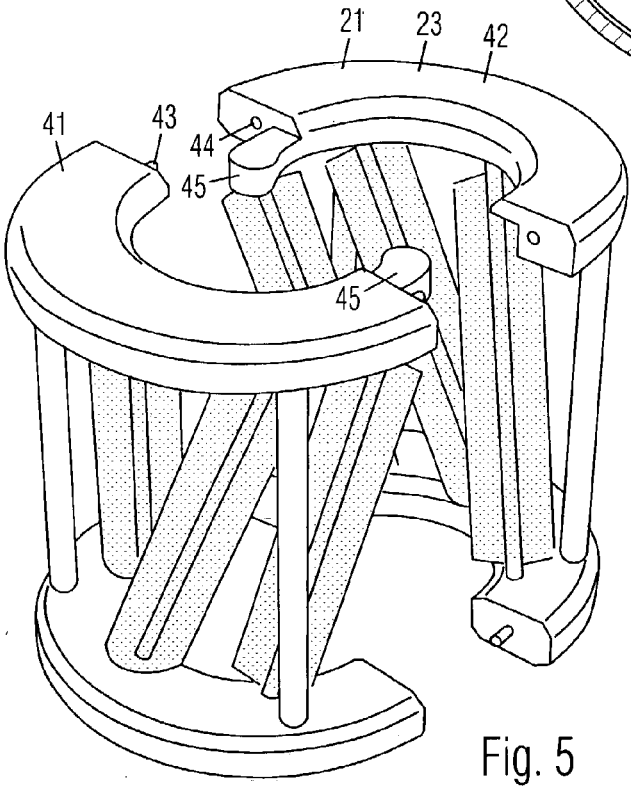
FIG. 5 is a perspective view of the rotary helical brush assembly disassembled.

FIG. 5:

Rotary helical brush assembly 21 is shown split apart in FIG. 5. Split rings 23 are each separable into two halves 41 and 42, and include pins 43 and holes 44 at abutting surfaces for mating with each other. Split rings 23 also include projections 45 extending from the abutting surfaces for attaching canted cylindrical brushes 25 that extend beyond the abutting surfaces.

Figure 6:
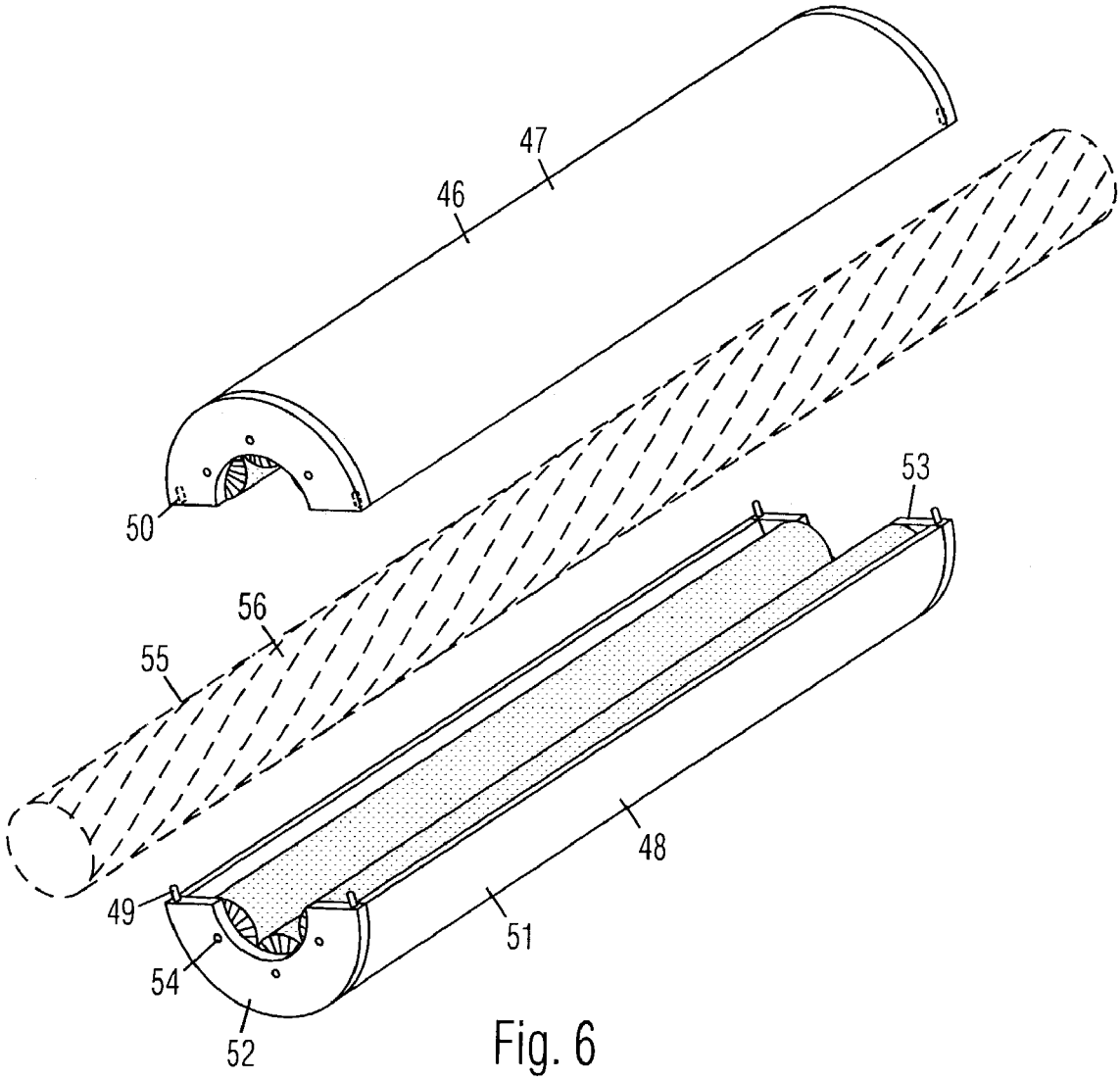
FIG. 6 is a perspective view of a second embodiment of the cylindrical member maintenance device.

FIG. 6:

A second embodiment of the cylindrical member maintenance device is shown in FIG. 6. It is comprised of a housing 46 comprised of two separable halves 47 and 48 connected by pins 49 and holes 50. Housing 46 is equivalent to spacers 24 and 27 in FIG. 1. Longitudinal rotary cylindrical brushes 51 are positioned inside housing 46 between split rings 52 and 53 at opposite ends of housing 46. Brushes 51 are independently rotatable about their own axle 54. Housing 46 is split apart and closed around a cylindrical member 55, such as a stranded steel cable. Brushes 51 are positioned to engage the steel cable. When housing 46 is moved along the steel cable, brushes 51 are rotated by helical strands 56 of the steel cable.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A cylindrical member maintenance device, comprising:

first ring and second rings coaxial with each other for positioning around a cylindrical member;

rotary cylindrical brushes connected between said first ring and said second ring positioned around a common axis of said first ring and said second ring, wherein said rotary cylindrical brushes are independently rotatable about respective axles; and a housing positioned around said first ring and said second ring, wherein said first ring and said second ring are simultaneously rotatable within said housing about an axis of said housing.

2. A cylindrical member maintenance device, comprising:

a housing comprising two half housings for opening and closing around a cylindrical member; and a rotary brush assembly positioned in said housing and rotatable about an axis of said housing, wherein said rotary brush assembly is comprised of coaxial split rings connected by spacers and rotary cylindrical brushes positioned around a common axis of said split rings, said brushes are independently rotatable about respective axles thereof, said split rings are each comprised of two half rings for opening and closing around said cylindrical member.

3. The cylindrical member maintenance device of claim 2, wherein said rotary cylindrical brushes are canted in a helical arrangement for engaging helical grooves in said cylindrical member.

4. The cylindrical member maintenance device of claim 2, wherein said rotary cylindrical brushes are parallel to said common axis of said split rings for engaging raised lands in said cylindrical member.

5. The cylindrical member maintenance device of claim 2, further including nozzles positioned inside said housing for connecting to a pressurized source of a material for applying said material to said cylindrical member.

6. The cylindrical member maintenance device of claim 2, further including suction apertures in said housing for connecting to a suction device for removing waste material from inside said housing to avoid contaminating an outside environment.

7. The cylindrical member maintenance device of claim 2, further including loops on said housing for attaching to cables for moving housing along cylindrical member, wherein said loops are positioned on opposite sides of said housing to prevent said housing from rotating about cylindrical member.

8. A cylindrical member maintenance device, comprising:

a housing comprising two half housings for closing around a cylindrical member;

split alignment rings in said housing for aligning said cylindrical member therein, wherein said split alignment rings are each comprised of two half rings attached to respective half housings, said split alignment rings are arranged for opening and closing around said cylindrical member;

a rotary brush assembly positioned in said housing and rotatable about an axis thereof, wherein said rotary brush assembly is comprised of axially spaced coaxial split rings connected by spacers and rotary cylindrical brushes positioned around a common axis of said split rings, said split rings are each comprised of two half rings for opening and closing around said cylindrical member, said rotary cylindrical brushes are independently rotatable about respective axles thereof;

nozzles positioned inside said housing for applying a material to said cylindrical member; and suction apertures in said housing for connecting to a suction device for removing waste material from inside said housing to avoid contaminating an outside environment.

9. The cylindrical member maintenance device of claim 8, wherein said rotary cylindrical brushes are canted in a helical arrangement for engaging helical grooves in said cylindrical member.

10. The cylindrical member maintenance device of claim 8, wherein said rotary cylindrical brushes are parallel to said common axis of said split rings for engaging raised lands in said cylindrical member.

11. The cylindrical member maintenance device of claim 8, further including loops on said housing for attaching to cables for moving housing along cylindrical member, wherein said loops are positioned on opposite sides of said housing to prevent said housing from rotating about cylindrical member.

12. The cylindrical member maintenance device of claim 8, further including a split sealing ring attached to said housing, wherein said split sealing ring has a larger inner diameter than respective inner diameters of said alignment rings to avoid touching said cylindrical member.

13. The cylindrical member maintenance device of claim 8, further including pins and holes at abutting surfaces of said split rings of said rotary brush assembly for mating with each other, and projections extending from said abutting surfaces for attaching said rotary cylindrical brushes that extend beyond said abutting surfaces.

* * * * *